US007866937B2

(12) United States Patent
Schlote

(10) Patent No.: US 7,866,937 B2
(45) Date of Patent: Jan. 11, 2011

(54) METHOD OF PUMPING GASEOUS MATTER VIA A SUPERSONIC CENTRIFUGAL PUMP

(75) Inventor: Andrew Schlote, Fenton, MO (US)

(73) Assignee: Innovative Energy, Inc., Valley Park, MO (US)

( * ) Notice: Subject to any disclaimer, the term of this patent is extended or adjusted under 35 U.S.C. 154(b) by 334 days.

(21) Appl. No.: 11/694,503

(22) Filed: Mar. 30, 2007

(65) Prior Publication Data

US 2008/0240904 A1 Oct. 2, 2008

(51) Int. Cl.
*F04D 21/00* (2006.01)

(52) U.S. Cl. ..... 415/1; 415/181; 415/206; 416/198 A

(58) Field of Classification Search ..... 415/1, 415/181, 206, 88, 115; 416/90 R, 91, 1, 416/198 A See application file for complete search history.

(56) References Cited

U.S. PATENT DOCUMENTS 3,771,925 A * 11/1973 Friberg et al. ..... 415/181
4,107,945 A * 8/1978 Eskeli ..... 62/499
5,123,811 A * 6/1992 Kuroiwa ..... 415/207
6,392,313 B1 5/2002 Epstein et al.
6,668,539 B2 12/2003 Schlote
6,996,971 B2 2/2006 Schlote
7,062,900 B1 6/2006 Brun
7,517,193 B2 * 4/2009 Higashimori ..... 416/188
2007/0151226 A1 7/2007 Schlote

OTHER PUBLICATIONS

International Search Report from corresponding PCT/US2008/057036.

* cited by examiner

*Primary Examiner*—Ninh H Nguyen
(74) *Attorney, Agent, or Firm*—Thompson Coburn LLP; Clyde L. Smith, Esq.

(57) ABSTRACT

A method of pumping gaseous matter comprises a step of providing a pump rotor, intake port, exhaust port, and gas passageway. The gas passageway operatively connects the intake port to the exhaust port. The exhaust port is radially farther from the rotor's center axis than is the intake port. The method also includes a step of providing a stator and a step of rotationally driving the pump rotor relative to the stator in a manner causing gaseous matter to enter the gas passageway of the pump rotor via the intake port, to gain energy, and to move radially away from the center axis and out of the exhaust port. The gaseous matter has a supersonic velocity relative to the stator upon exiting the exhaust port. The method can be used to evacuate or compress gaseous matter.

6 Claims, 6 Drawing Sheets

METHOD OF PUMPING GASEOUS MATTER VIA A SUPERSONIC CENTRIFUGAL PUMP

FIELD OF THE INVENTION

The present invention pertains to rotary pumps for use in compressing or evacuating gaseous matter. More particularly, the present invention pertains to rotationally driving a rotary pump in a manner such that the rotary pump discharges gaseous matter at supersonic velocities.

BACKGROUND OF THE INVENTION

It is know to utilize centrifugal pumps to compress gaseous matter. Such pumps typically comprise a rotor or impeller that rotates about an axis in manner creating centrifugal force on gaseous matter that is in contact with or contained within the rotor. The centrifugal force on the on the gaseous matter creates a pressure differential that can be used to either evacuate or compress gaseous matter.

The rotor of a centrifugal pump typically comprises a plurality of radially oriented gas passageways or spiral gas passageways, either between rotor vanes or within the rotor. On rotors having spiral gas passageways, the spirals typically swirl in a direction opposite the direction of rotor rotation as the gas passageways extend away from the axis of rotation.

High pressure ratio pumps, such as pumps able to generate pressure ratios in excess of four, typically comprise multiple rotors operating in series (multistage) or utilize piston style pumps in lieu of centrifugal rotors. The use of multiple rotors makes the cost and maintenance of multistage compressors greater than that of single-stage compressors. Piston style pumps are generally not well suited for applications requiring steady-state operation.

SUMMARY OF THE INVENTION

The present invention is directed to a single-stage centrifugal pump that is capable of producing steady-state pressure ratios in excess of two, and preferably in excess of four.

In one aspect of the invention, a method of pumping gaseous matter comprises a step of providing a pump rotor having a center axis, an intake port, an exhaust port, and a gas passageway. The gas passageway operatively connects the intake port to the exhaust port. The exhaust port is radially farther from the center axis than is the intake port. The method also includes a step of providing a stator having a chamber that is in gaseous communication with the exhaust port of the pump rotor. The method yet further comprises a step of rotationally driving the pump rotor about the center axis relative to the stator in a manner causing gaseous matter to enter the gas passageway of the pump rotor via the intake port, to gain energy, and to move radially away from the center axis and out of the exhaust port into the chamber of the stator. The gaseous matter has a supersonic velocity relative to the stator upon exiting the exhaust port.

In another aspect of the invention, a method of pumping gaseous matter comprises a step of providing a pump rotor having a center axis, an intake port, an exhaust port, and a gas passageway. The gas passageway operatively connects the intake port to the exhaust port. The exhaust port is radially farther from the center axis than is the intake port. The method also comprises a step of providing a stator having a chamber that is in gaseous communication with the exhaust port of the pump rotor. The method yet further comprises a step of rotationally driving the pump rotor about the center axis relative to the stator in a manner causing gaseous matter to enter the gas passageway of the pump rotor via the intake port, to gain energy, and to move radially away from the center axis and out of the exhaust port into the chamber of the stator. The rotational driving the pump rotor also occurs in a manner such that the exhaust port moves circumferentially about the center axis in a forward direction relative to the stator and the gaseous matter is expelled from the exhaust port having a velocity component in the forward direction relative to the exhaust port.

In yet another aspect of the invention, a method of pumping gaseous matter comprises a step of providing a pump rotor having a center axis, an intake port, an exhaust port, and a gas passageway. The gas passageway operatively connects the intake port to the exhaust port. The exhaust port is radially farther from the center axis than is the intake port. The method also comprises a step of rotationally driving the pump rotor about the center axis in a manner causing gaseous matter to enter the gas passageway of the pump rotor via the intake port, to gain energy, and to move radially away from the center axis and out of the exhaust port. The rotational driving the pump rotor also occurs in a manner such that the exhaust port moves circumferentially about the center axis in a forward direction and the gaseous matter is expelled from the exhaust port having a velocity component in the forward direction relative to the exhaust port.

While the principal advantages and features of the invention have been described above, a more complete and thorough understanding of the invention may be obtained by referring to the drawings and the detailed description of the preferred embodiment, which follow.

Figure 1:
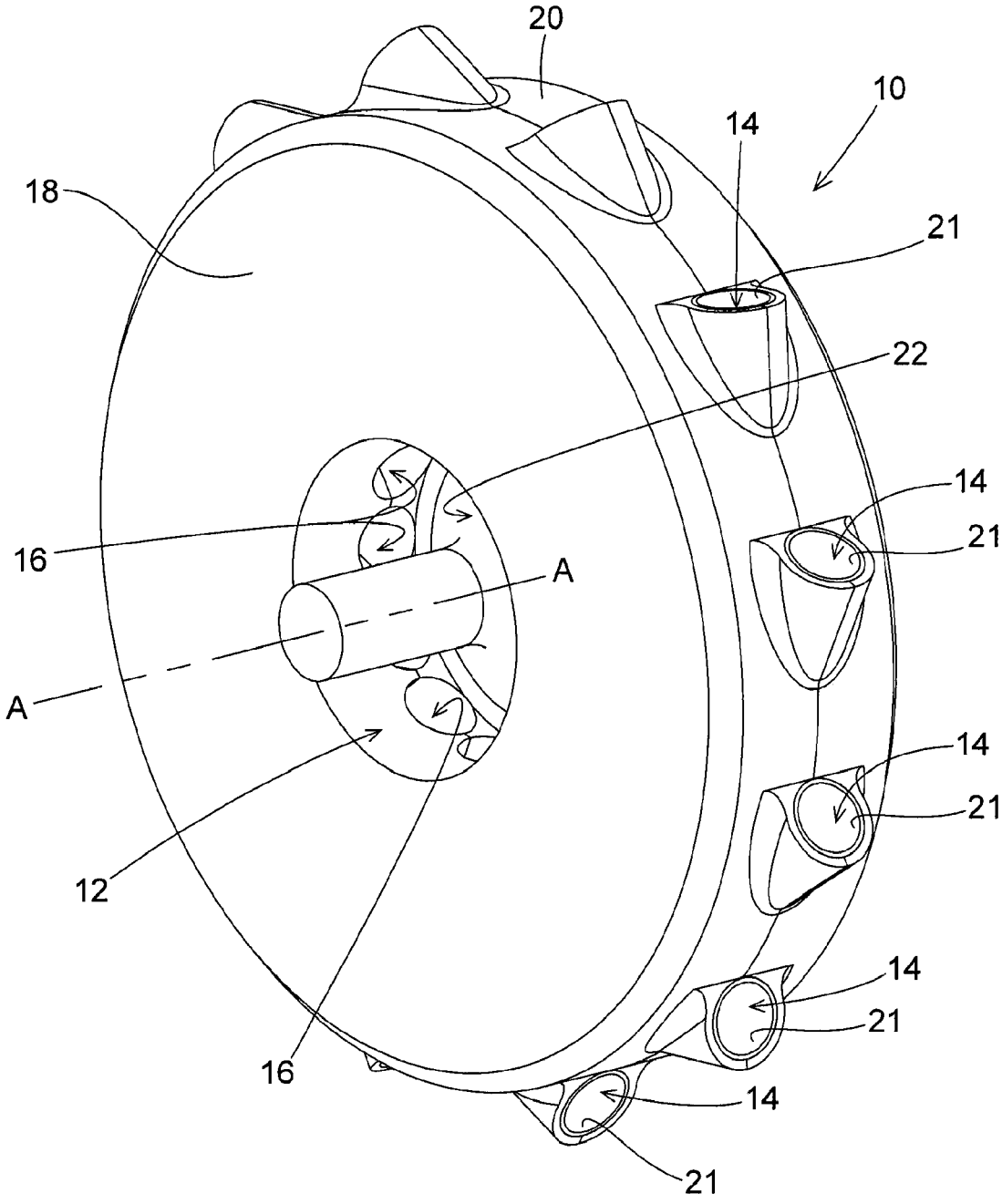
FIG. 1 is a perspective view of the preferred embodiment of a rotor assembly of a pump in accordance with the invention.
Figure 2:
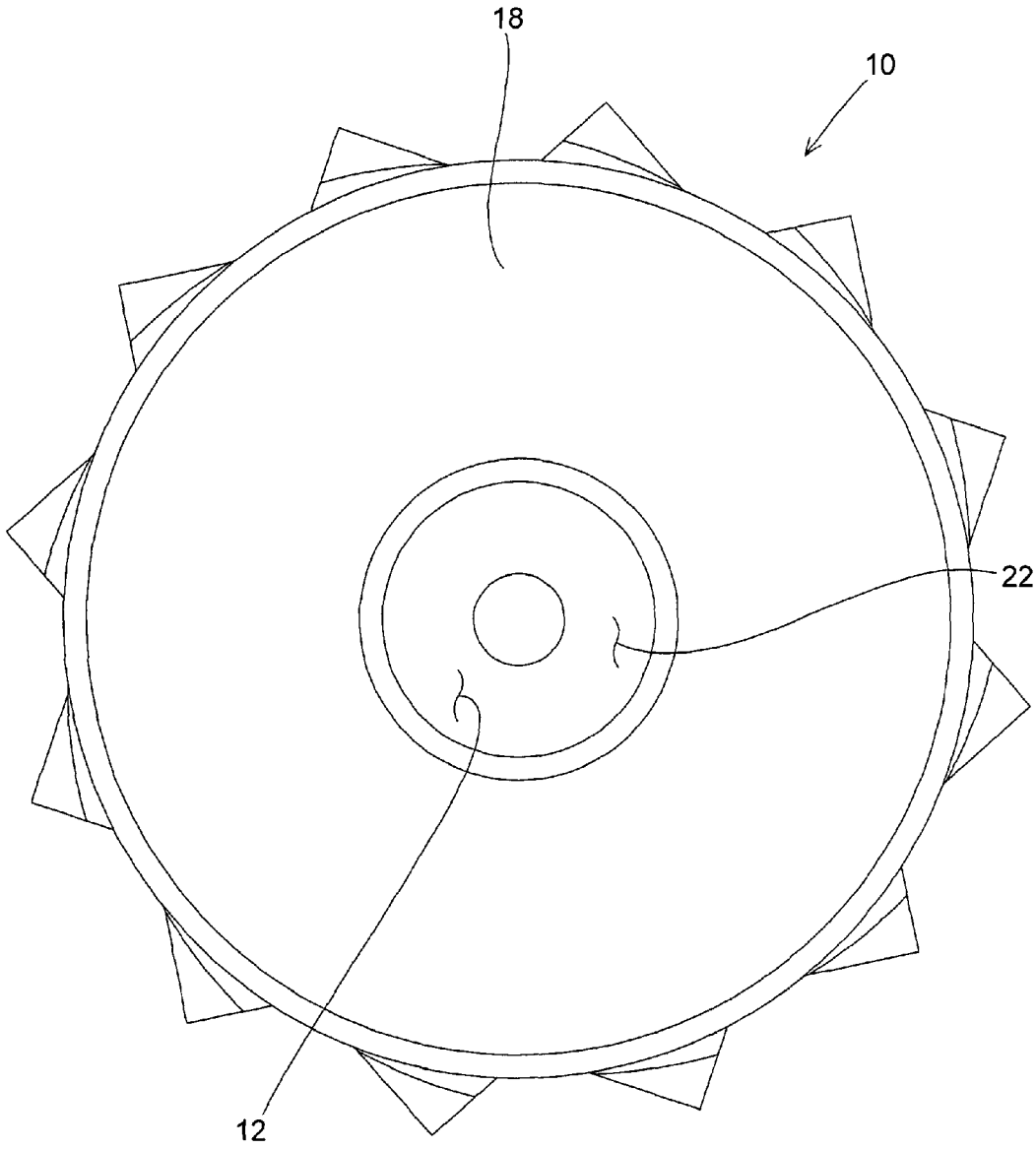
FIG. 2 is a view of the rotor assembly shown in FIG. 1, from a line-of-sight parallel to the axis of rotation.

Reference characters in the written specification indicate corresponding items shown throughout the drawing figures.

DETAILED DESCRIPTION OF THE PREFERRED EMBODIMENT OF THE INVENTION

FIG. 1 depicts a rotor 10 that forms at least a part of a centrifugal pump in accordance with the invention. The rotor 10 is adapted to rotate about an axis A-A and comprises an intake port 12 that is preferably circular an preferably aligned with the axis A-A. The rotor 10 also comprises a plurality of exhaust ports 14 spaced circumferentially about the axis A-A. Each of the exhaust ports 14 is operatively connected to the intake port 12 via a gas passageway 16. For fabrication purposes, the rotor 10 is preferably formed of two main portions, a front portion 18 and a rear portion 20, and plurality of removable nozzles 21. Preferably half of each gas passageway 16 is formed into the front portion 18 of the rotor 10, and the other half into the rear portion 20. Each of the gas passageways 16 extends through a respective one of the nozzles 21. The nozzles 21 preferably form the exhaust ports 14.

Figure 3:
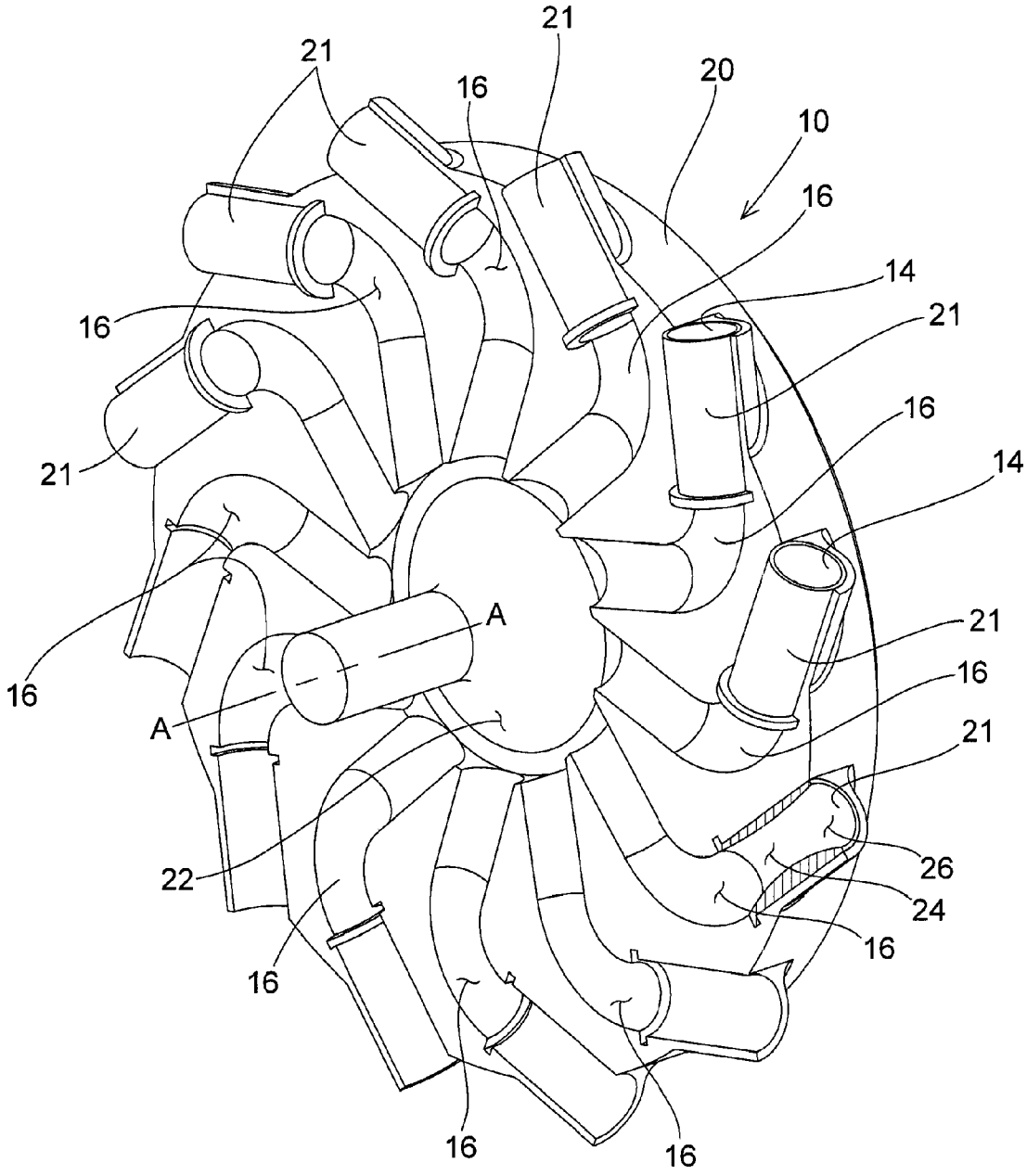
FIG. 3 a perspective view of the rear portion of the rotor assembly shown in FIGS. 1 and 2 with some nozzles positioned thereon, one of such nozzles being shown in cross-section.
Figure 4:
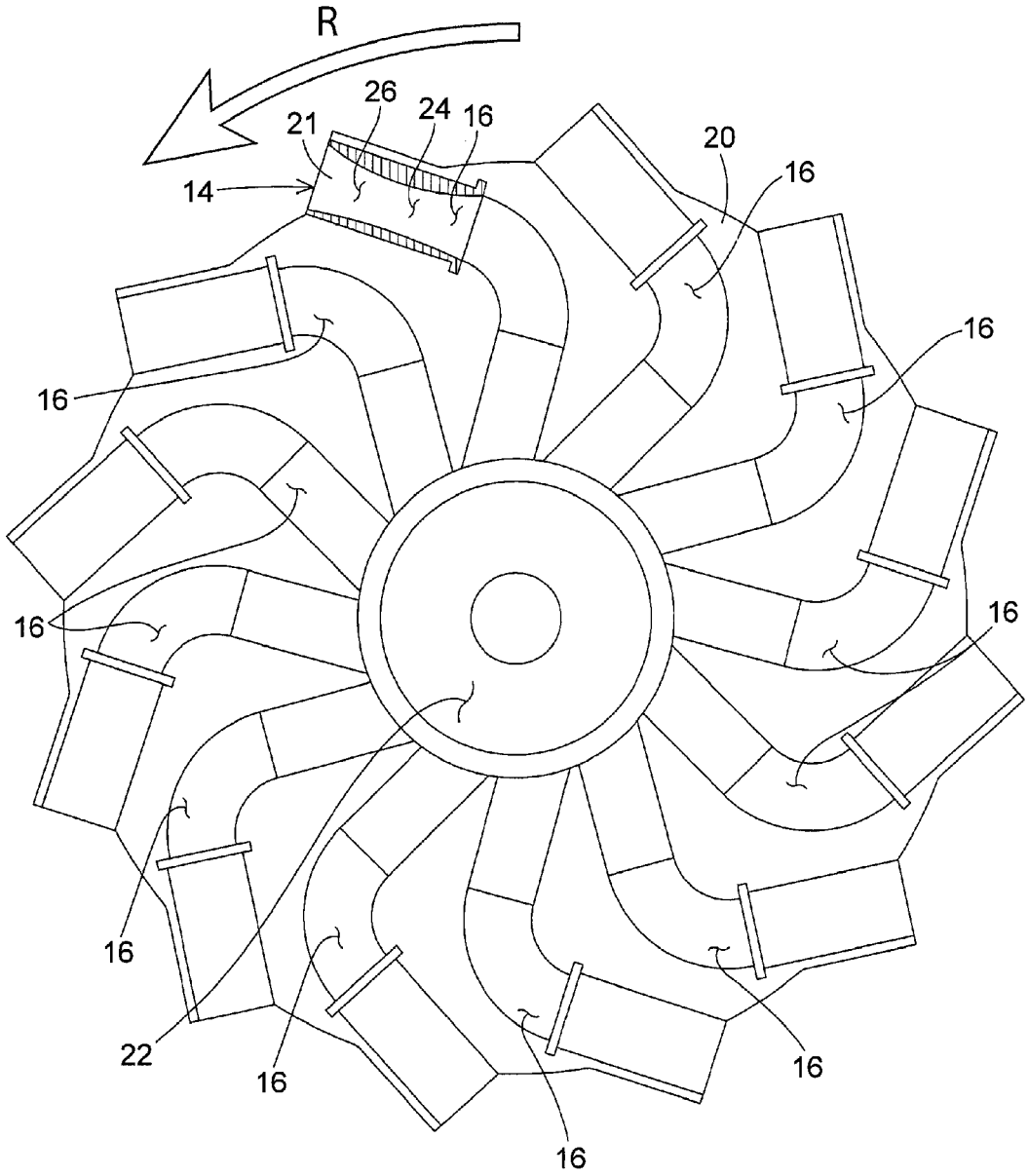
FIG. 4 is a view of that which is shown in FIG. 3, but from a line-of-sight parallel to the axis of rotation.
Figure 5:
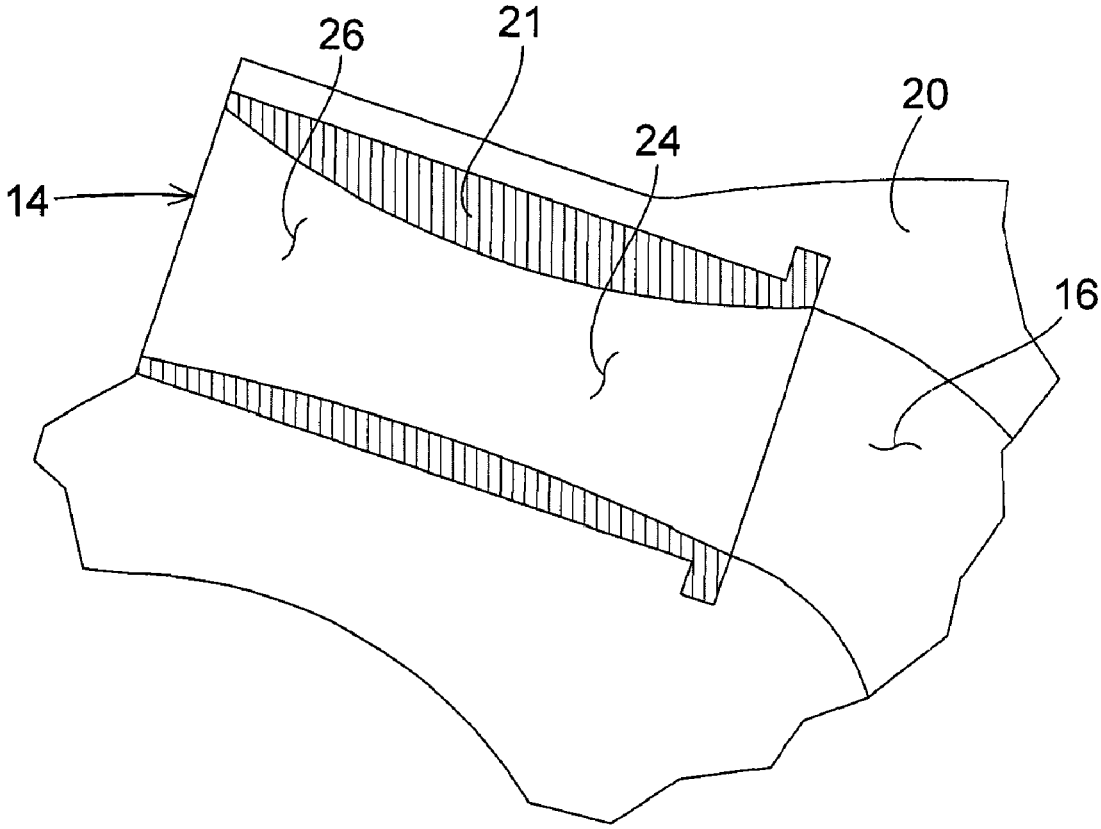
FIG. 5 is a detail view of the cross-sectioned nozzle as shown in FIG. 4.

FIGS. 3 and 4 are views of the rear portion of the rotor with a few of the nozzles positioned thereon and with one of the nozzles shown in cross-section (which is detailed in FIG. 5). As evident in FIG. 4, the each of the gas passageways 16 is operatively connected to an intake plenum 22. The intake plenum 22 is preferably generally cylindrical and is in direct communication with intake port 12. From the intake plenum 22, each gas passageway 16 extends radially away from the axis A-A to a respective one of the exhaust ports 24. As each gas passageway 16 extends away from the axis A-A, it also preferably curves along a path that turns in the direction R (see FIG. 4) of rotation of the rotor 10. Preferably after turning, each gas passageway 16 extends through one of the removable nozzles 21. Each of the exhaust ports 14 is oriented and configured to discharge thrust matter from the gas passageway 16 in a direction both radially outward and circumferentially in the direction R of the rotation of the rotor 10.

Each gas passageway 16 preferably comprises a converging region 24 and diverging region 26 that are preferably formed by the nozzles. The diverging region 26 lies between the respective exhaust port 14 and the converging region 24. The cross-sectional area of each gas passageway 16 decreases as it extends within the converging region 24 toward the diverging region 26. Conversely, the cross-sectional area of each gas passageway 16 increases as it extends within the diverging region 24 from the end of the converging region 24 toward the respective exhaust port 14. The narrowest portion of each gas passageway 16 preferably lies between its converging region 24 and its diverging region 26 (i.e., at the throat within the nozzle 21) and preferably has an area that is at most one half of the area of the widest portion of the gas passway. However, this ratio can be adjusted by replacing the nozzles with nozzles having a larger or smaller throat areas. As most evident in FIG. 5, the nozzles 21 are preferably asymmetric such that each gas passageway 16 curves slightly in a direction opposite to the direction it curved upstream of the nozzles. This brings the center of flow exiting each exhaust port 14 near to the center of such exhaust port for smooth discharge of gaseous matter from the exhaust ports 14.

In use, the rotor 10 is rotationally driven about axis A-A (as shown FIG. 3) in the direction R (as shown in FIG. 4). The rotor 10 may be driven, either directly or indirectly by an electric motor, an internal combustion engine, a rotary heat engine, steam turbine, hydraulic motor, pneumatic motor, or any other device capable of applying torque to the rotor. As the rotor 10 rotates, gaseous matter within the gas passageways 16 of the rotor experiences centrifugal force and thereby moves radially away from the axis A-A. As a result, the gaseous matter is forced out of the rotor 10 through the exhaust ports 14 and additional gaseous matter is drawn into the intake plenum 22 through the intake port 12. Assuming the ratio of total pressure at the exhaust ports 14 and total pressure at the intake port 12 is constant and the rotational velocity of the rotor 10 is constant, this generates a steady state of gaseous matter flow from the lower pressure at the intake port to the higher pressure at the exhaust port.

Preferably, the rotational speed at which the rotor 10 is driven is sufficiently high so as to accelerate gaseous matter within the gas passageways 16 to a speed slightly less than Mach 1.0 as the gaseous matter nears the converging regions 24 of the gas passageways 16. As such, the gaseous matter further accelerates as it passes through the converging regions 24 of the gas passageways 16 and preferably goes supersonic upon entering the diverging regions 26 of the gas passageways, thereby further accelerating within the diverging regions. Thus, gaseous matter is preferably expelled from the exhaust ports 14 of the rotor 10 at a supersonic speed relative to the rotor. As mentioned-above, the nozzles 21 are preferably removable and replaceable with similar nozzles having smaller or larger throat areas. This allows the discharge velocity of gaseous matter to be controlled to account for various intake pressures, back pressures, and properties of the gaseous matter being discharge.

Figure 6:
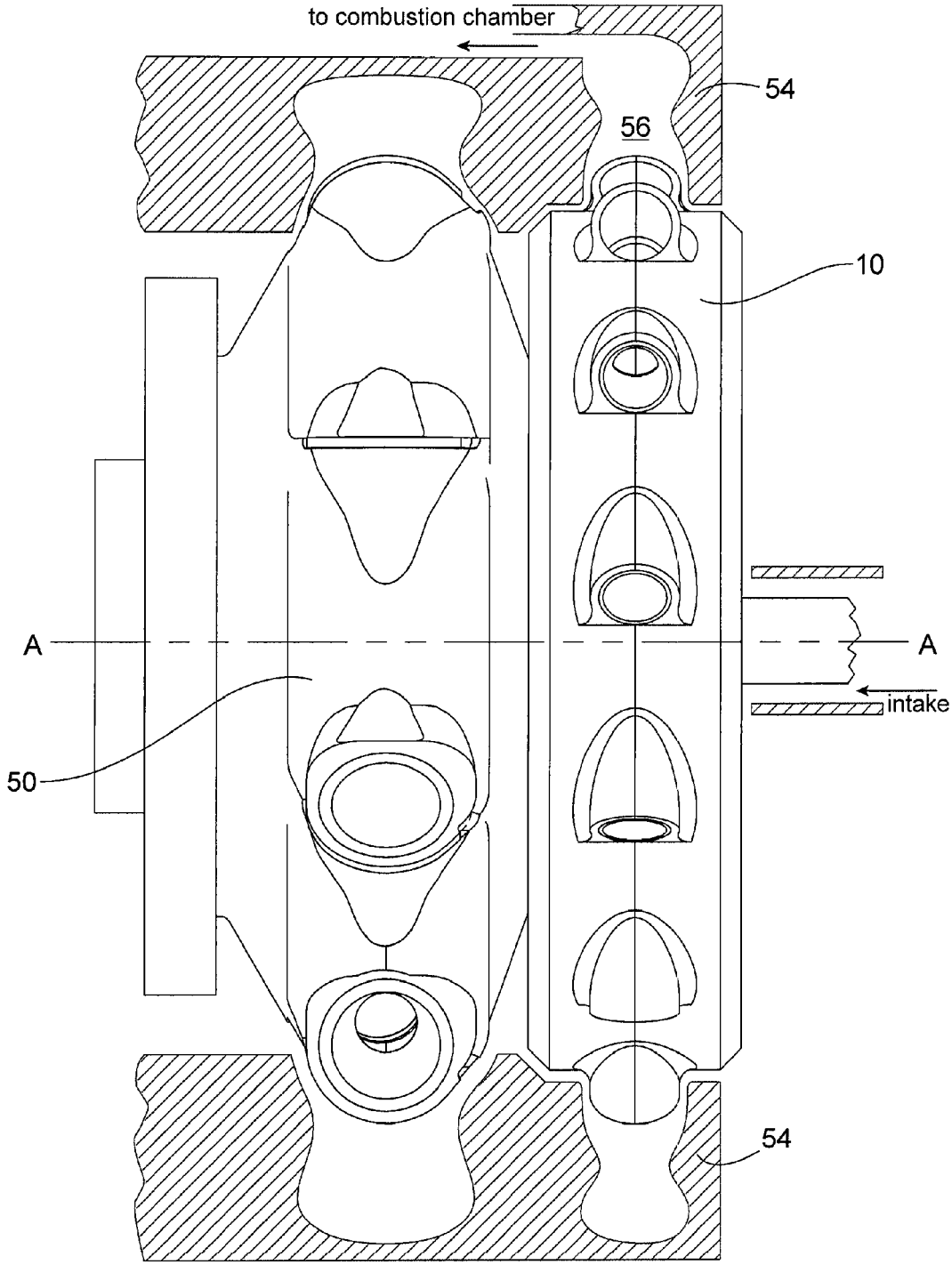
FIG. 6 is a schematic view of a rotary heat engine assembly shown incorporating a pump in accordance with the invention, from a line-of-sight perpendicular to the axis of rotation.

FIG. 6 depicts the rotor 10 being used as a compressor and as a component of a rotary heat engine 50. The rotary heat engine is preferably of a type disclosed in U.S. patent application Ser. No. 11/324,604, entitled Rotary Heat Engine, and filed Jan. 3, 2006, or disclosed in U.S. Pat. No. 6,668,539, entitled Rotary Heat Engine, and filed Aug. 20, 2001, which are hereby incorporated by reference in their entirety. As depicted, the rotor 10 serves the function of compressing air prior to such air being mixed with fuel and used in combustion to generate heat to power the rotation of the engine rotor 52. Preferably, the rotor 10 of the centrifugal pump is fixedly attached to the engine rotor 52 such that the rotor of the centrifugal pump rotates with and is driven by the engine rotor. A stator 54 surrounds the rotor 10 of the centrifugal pump and comprises an interior chamber 56 that is in direct and constant gaseous communication with the exhaust ports 14 of the rotor. Air from an environment external to the heat engine 50 is drawn into the rotor 10 and discharge from the exhaust ports 14 of the rotor as described above. The chamber 56 of stator 54 preferably acts as a diffuser, thereby slowing the discharged air down to a subsonic velocity and increasing its static pressure. The subsonic air then flows through a duct 58 to the air inlet of the engine rotor 52.

It should be appreciated that gaseous matter discharge from the rotor 10 needs not necessarily have a supersonic velocity relative to the rotor for it to have a supersonic velocity relative to the stator 54. This is because the gaseous matter is discharged into the direction of rotation and therefor has a velocity relative to the stator 54 equal to the discharged velocity from the rotor 10 plus the velocity of the exhaust ports 14 relative to the stator. As such, the gas passageways 16 of the rotor 10 need not necessarily comprises converging and diverging regions 24, 26 for the discharged gaseous matter to have a supersonic velocity discharge velocity relative to the stator 54.

While the present invention has been described in reference to a specific embodiment, in light of the foregoing, it should be understood that all matter contained in the above description or shown in the accompanying drawings is intended to be interpreted as illustrative and not in a limiting sense and that various modifications and variations of the invention may be constructed without departing from the scope of the invention defined by the following claims. For example, when the rotor is used as a vacuum pump as opposed to a compressor, the exhaust ports 16 of the rotor need not discharge into any chamber of a stator and could instead discharge directly into the atmosphere. Thus, other possible variations and modifications should be appreciated.

Furthermore, it should be understood that when introducing elements of the present invention in the claims or in the above description of the preferred embodiment of the invention, the terms "comprising," "including," and "having" are intended to be open-ended and mean that there may be additional elements other than the listed elements. Additionally, the term "portion" should be construed as meaning some or all of the item or element that it qualifies. Moreover, use of identifiers such as first, second, and third should not be construed in a manner imposing any relative position or time sequence between limitations. Still further, the order in which the steps of any method claim that follows are presented should not be construed in a manner limiting the order in which such steps must be performed unless such steps must inherently be performed in such order.

What is claimed is:

1. A method of pumping gaseous matter comprising:

providing a pump rotor having a center axis, an intake port, an exhaust port, and a gas passageway, the gas passageway operatively connecting the intake port to the exhaust port, the exhaust port being radially farther from the center axis than is the intake port;

providing a stator having a chamber that is in gaseous communication with the exhaust port of the pump rotor; and rotationally driving the pump rotor about the center axis relative to the stator in a manner causing gaseous matter to enter the gas passageway of the pump rotor via the intake port, to gain energy, and to move radially away from the center axis and out of the exhaust port into the chamber of the stator, the gaseous matter having a supersonic velocity relative to the stator and a subsonic velocity relative to the exhaust port upon exiting the exhaust port.

2. A method of pumping gaseous matter comprising:

providing a pump rotor having a center axis, an intake port, an exhaust port, and a gas passageway, the gas passageway operatively connecting the intake port to the exhaust port, the exhaust port being radially farther from the center axis than is the intake port;

providing a stator having a chamber that is in gaseous communication with the exhaust port of the pump rotor;

rotationally driving the pump rotor about the center axis relative to the stator in a manner causing gaseous matter to enter the gas passageway of the pump rotor via the intake port, to gain energy, and to move radially away from the center axis and out of the exhaust port into the chamber of the stator, the gaseous matter having a supersonic velocity relative to the stator upon exiting the exhaust port; and operating a rotary heat engine having an engine rotor in a manner by generating mechanical energy by expelling gaseous matter from the engine rotor, the step of rotationally driving the pump rotor occurring directly from the mechanical energy, at least some of the gaseous matter discharged from the pump rotor being channeled into the engine rotor.

3. A method in accordance with claim 2 wherein the engine rotor and the pump rotor are directly connected to each other in a manner such that the engine rotor and the pump rotor are fixed in position relative to each other.

4. A method of pumping gaseous matter comprising:

providing a pump rotor having a center axis, an intake port, an exhaust port, and a gas passageway, the gas passageway operatively connecting the intake port to the exhaust port, the exhaust port being radially farther from the center axis than is the intake port;

providing a stator having a chamber that is in gaseous communication with the exhaust port of the pump rotor; and rotationally driving the pump rotor about the center axis relative to the stator in a manner causing gaseous matter to enter the gas passageway of the pump rotor via the intake port, to gain energy, and to move radially away from the center axis and out of the exhaust port into the chamber of the stator, and in a manner such that the exhaust port moves circumferentially about the center axis in a forward direction relative to the stator and the gaseous matter is expelled from the exhaust port having a velocity component in the forward direction relative to the exhaust port, a subsonic velocity relative to the exhaust port and a supersonic velocity relative to the stator.

5. A method of pumping gaseous matter comprising:

providing a pump rotor having a center axis, an intake port, an exhaust port, and a gas passageway, the gas passageway operatively connecting the intake port to the exhaust port, the exhaust port being radially farther from the center axis than is the intake port;

providing a stator having a chamber that is in gaseous communication with the exhaust port of the pump rotor;

rotationally driving the pump rotor about the center axis relative to the stator in a manner causing gaseous matter to enter the gas passageway of the pump rotor via the intake port, to gain energy, and to move radially away from the center axis and out of the exhaust port into the chamber of the stator, and in a manner such that the exhaust port moves circumferentially about the center axis in a forward direction relative to the stator and the gaseous matter is expelled from the exhaust port having a velocity component in the forward direction relative to the exhaust port; and operating a rotary heat engine having an engine rotor in a manner by generating mechanical energy by expelling gaseous matter from the engine rotor, the step of rotationally driving the pump rotor occurring directly from the mechanical energy, at least some of the gaseous matter discharged from the pump rotor being channeled into the engine rotor.

6. A method in accordance with claim 5 wherein the engine rotor and the pump rotor are directly connected to each other in a manner such that the engine rotor and the pump rotor are fixed in position relative to each other.

* * * * *